United States Patent [19]

Tate, Sr.

[11] 4,232,867

[45] Nov. 11, 1980

[54] PORTABLE TARGET RAISING AND LOWERING DEVICE SYSTEM

[76] Inventor: Edward D. Tate, Sr., 165 Charles Cir., Seaford, Va. 23696

[21] Appl. No.: 24,915

[22] Filed: Mar. 29, 1979

[51] Int. Cl.[3] ..... F41J 7/00; F41J 7/02

[52] U.S. Cl. ..... 273/406

[58] Field of Search ..... 273/105.6, 102.1 E

[56] References Cited

U.S. PATENT DOCUMENTS

| | | | |
|---|---|---|---|
| 945,512 | 1/1910 | Gates | 273/105.6 |
| 960,892 | 6/1910 | Gates | 273/105.6 X |

FOREIGN PATENT DOCUMENTS

| | | | |
|---|---|---|---|
| 1118015 | 6/1968 | United Kingdom | 273/105.6 |

*Primary Examiner*—Paul E. Shapiro

*Attorney, Agent, or Firm*—William G. Gapcynski; Sherman D. Winters; Werten F. W. Bellamy

[57] ABSTRACT

A portable target raising and lowering device system is disclosed which is used for gunnery practice. A remotely controlled motor arrangement moves the target from a lowered position to a raised position, and back again. The device system is capable of operation with specialized targets used for either simulated visible laser training guns or live fire. When live fire is used, a target is employed which does not engage a motor-actuated control arm on the return stroke and a magnet is used to hold the target in the raised position until the target is hit and knocked to the down position. If the target is not hit, a solenoid is used to move the target to the down position.

8 Claims, 11 Drawing Figures

PORTABLE TARGET RAISING AND LOWERING DEVICE SYSTEM

FIELD OF THE INVENTION

This invention relates generally to apparatus for use in gunnery target practice and more particularly to a portable, (remotely operated) control device for raising and lowering a gunnery target.

BACKGROUND OF THE INVENTION

Perhaps the most common type of target holder used for gunnery practice is a simple stationary frame which is made from wood and which is partially embedded in the ground, the target, being attached to the frame by staples, thumbtacks or the like. In another system used by the military for situations where firing at the target takes place for a limited period of time, trenches are dug in the ground and target holders are mounted on vertical runners which extend above the ground level. The target holders are then manually raised and lowered for the time period desired by an operator located in the trench.

There are a number of obvious disadvantages to each of the prior art systems. With the simple stationary frame, there is no way to control the time during which the target is exposed and this, of course, detracts from the realism of the simulation provided. On the other hand, the manually operated system limits the location of the target holder to the area of the trench, among other disadvantages.

SUMMARY OF THE INVENTION

In accordance with the present invention, a remotely controlled portable control device system is provided for raising and lowering gunnery targets. The device is capable of operation with either live fire or simulated visible laser fire and provides a specialized mode of operation for each type of fire. The device system is reliable and rugged and can be placed wherever desired. According to a preferred embodiment, the invention comprises a rotatable control shaft, a target holder freely mounted on the shaft, a control arm affixed to the shaft and motor (preferably an electric motor) means for rotating the control shaft so as to cause the control arm to engage the target holder and thereby cause rotation thereof. In a first mode of operation, adapted for use with simulated firing, a target is used which is engaged by the control arm during both raising and lowering movements. In a second, live firing mode, a target is used from which control arm disengages during the movement of the latter to the rest position thereof. A solenoid returns the target holder to the lowered position and a magnet retains the target holder in the raised position.

Other features and advantages of the present invention are stated in or are apparent from the detailed description of presently preferred embodiments, 1/20 scale system (FIGS. 4, 5, 6 & 7) and 1/60-1/35 scale system (FIGS. 8, 9, 10 & 11), of the invention found hereinbelow.

DETAILED DESCRIPTION OF THE PREFERRED EMBODIMENTS (1/20 AND 1/60–1/35 SYSTEMS)

Figure 1:
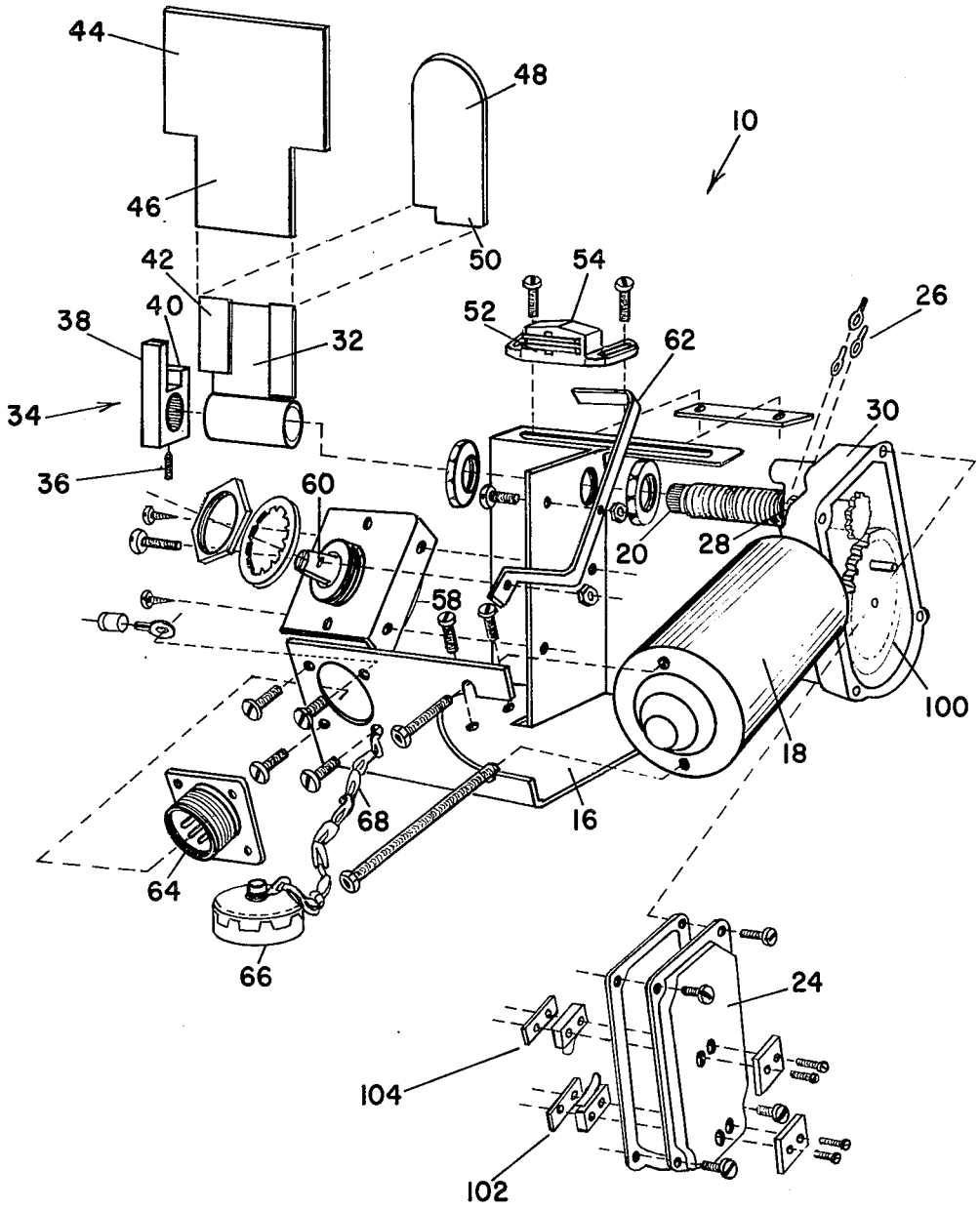
FIG. 1 is an exploded perspective view of a preferred embodiment of the control device of the present invention as viewed from the rear.
Figure 2:
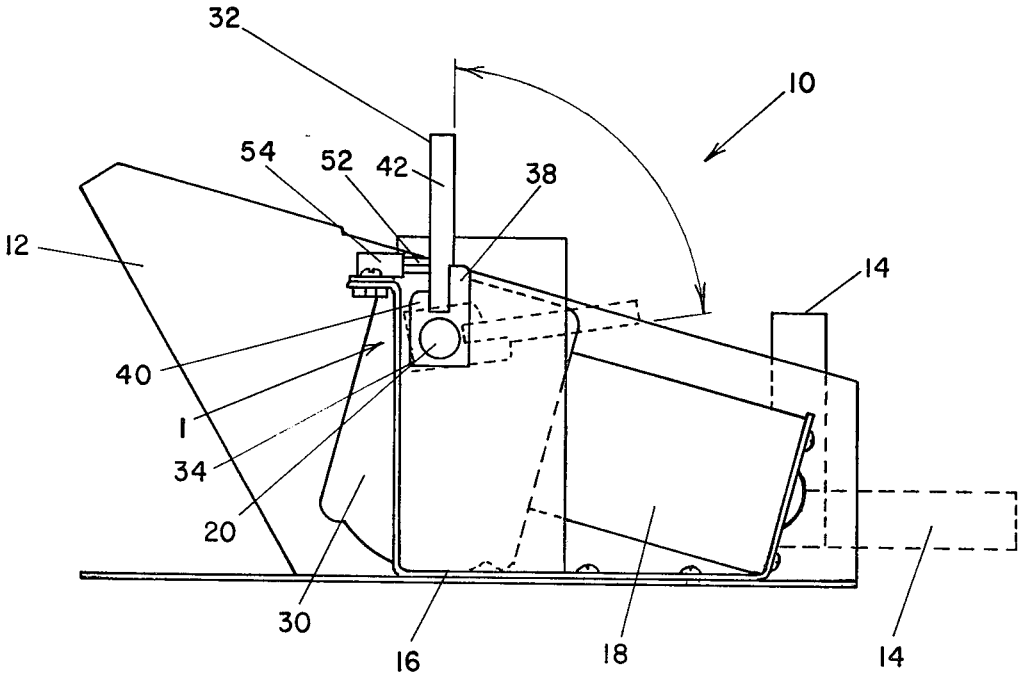
FIG. 2 is a simplified sectional side view of the control device of the present invention.
Figure 3:
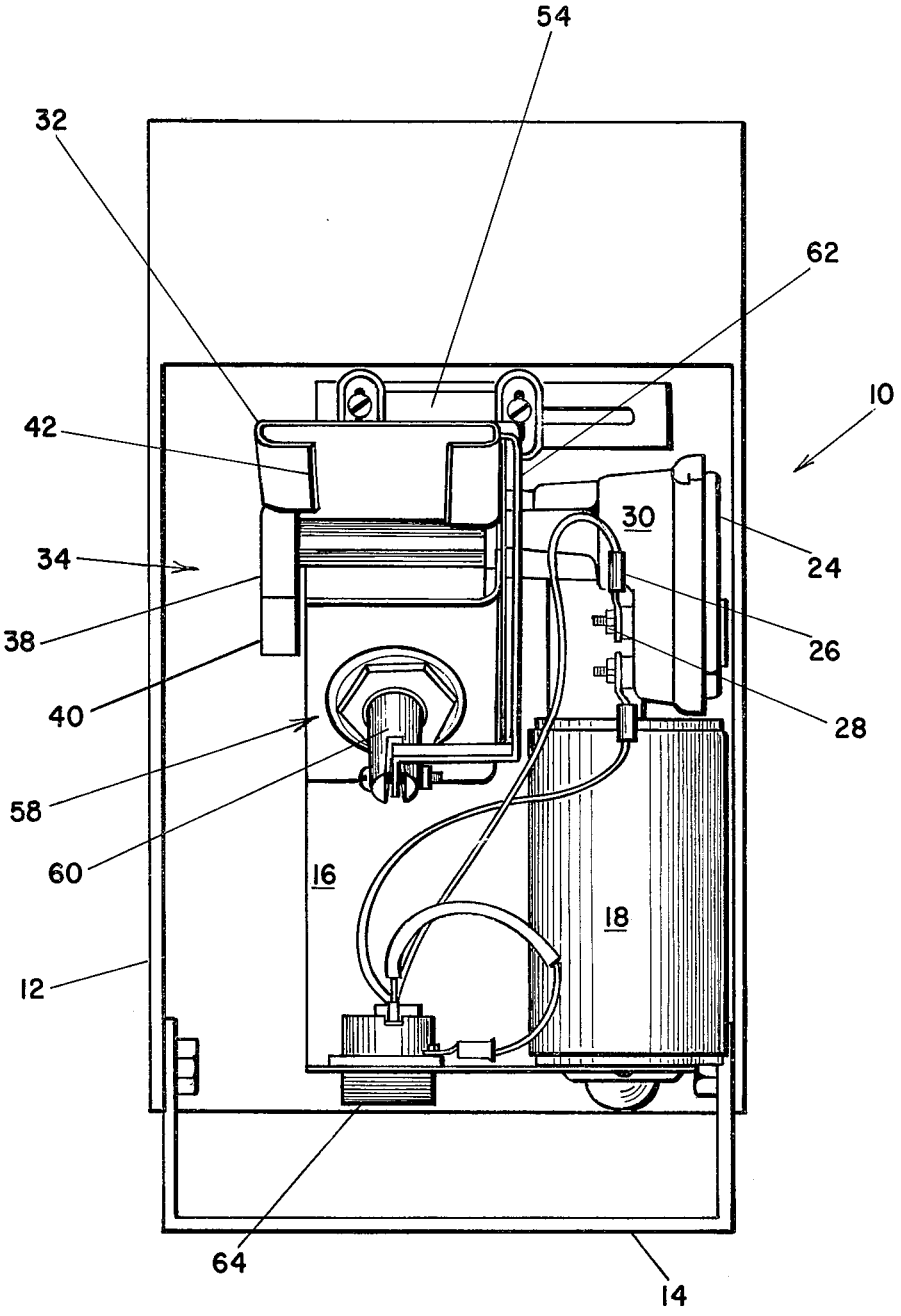
FIG. 3 is a plan view of the control device of the present invention.

With reference now to the drawings in which like numerals represent like elements throughout the several views, a presently preferred embodiment of the present invention is depicted in FIGS. 1, 2 and 3 and comprises a portable target raising and lowering device 10 located in a housing 12. A pivoting handle 14, attached at the rear of housing 12, is used in the lower position to carry device 10 and in the upper position acts as a target rest. Attached to the inside of housing 12 is a frame 16. Mounted on a rear inclined portion of frame 16 is a first remotely controlled motor 18. A suitable motor is the windshield wiper motor made by "American Bosch", code No. WWF24C. Motor 18 rotates or turns an associated control shaft 20 through an approximately 85° arc, and then back again. Arc is a function of mechanical linkage inside cover 24 between shaft 20 and drive gear 100. Stops at raised and lowered positions are controlled by control switches 102 and 104 being mechanically engaged by drive gear 100. Electrical connections to motor 18 are made by a set of terminals 26 which attach to suitable contact screws 28 provided on the exterior of a motor gear housing 30.

Control shaft 20 extends from motor gear housing 30 through an upstanding portion of frame 16, as illustrated. A target holder 32, made from a magnetic material, is freely mounted on control shaft 20 between the upstanding portion of frame 16 and a control arm 34. The control arm 34 is rigidly attached to the end of control shaft 20 by suitable fasteners such as screws 36. Extending upward at the rear of control arm 34 is a long leg 38, while a short leg 40 extends upward at the front of control arm 34. As can be seen from FIGS. 1 and 2, when control arm 34 is rotated to a raised position, the long leg 38 engages flange 42 of target holder 32 and thus moves target holder 32 from a lowered position to a raised position. However, when control arm 34 is rotated to a lowered position, the short leg 40 of control arm 34 does not engage flange 42.

Two types of targets are designed to be used with device 10. A laser target, indicated at 44, is fabricated from $\frac{1}{8}''$ plastic sheet covered with retroreflective tape on which the target silhouette is slikscreened using a retroreflective paint. An extension 46 of laser target 44 which is adapted to be received in target holder 32 is square ended and thus extends downward until the extension 46 contacts control arm 34, and extension 46 then lies between long leg 38 and short leg 40. Therefore, when control arm 34 is rotated to a lowered position from a raised position, it contacts extension 46 and brings laser target 44, as well as target holder 32, down with it.

The other type of target designed to be used with device 10 is an impact target, denoted 48, which is used with live fire. Impact target 48 is likewise made from ⅛" plastic and is cut to conform to the shape of the silhouette painted on the front. An extension 50 provided on impact target 48 is shaped similarly to extension 46 of laser target 44, except that a corner of extension 50 is cut away as illustrated. This cut away corner of extension 50 is large enough so that short leg 40 of control 34 does not engage impact target 44. Thus, when control arm 34 is rotated to a lowered position, neither target holder 32 nor impact target 44 is engaged by control arm 34. In fact, when control arm 34 is rotated to the lowered position, impact target 44 is held in an upright position by a magnet 52 which engages target holder 32. Magnet 52 is mounted in a magnet holder 54 which is adjustably mounted on the upstanding portion of frame 16. By adjusting the position of magnet 52, the holding force which magnet 52 exerts on target holder 32 is adjusted so that target holder 32 can overcome or break this holding force and fall down to the lower position when impact target 48 is hit with a round of live ammunition.

Impact target 48 can also be moved from its raised position to its lowered position by a solenoid 58 which is attached to the upstanding portion of frame 16 and includes a solenoid armature 60. The end of solenoid armature 60 which extends out of solenoid 58 is attached to one end of a knockdown arm 62. Knockdown arm 62 is attached to the upstanding portion of frame 16 which acts as a pivot point. The other end of knockdown arm 62 is bent around just in front of the position occupied by the forward surface of target holder 32 when target holder 32 is in the raised position. When target holder 32 is in its raised position and is held by magnet 52, actuation of solenoid 58 causes solenoid armature 60 to retract into solenoid 58. This causes knockdown arm 62 to act in such a way that the end of knockdown arm 62 which is bent around in front of target holder 32 pushes target holder 32 away from magnet 52. After being pushed away from magnet 52, target holder 32 by the force of garvity comes to rest in its lowered position.

Electrical connections to the raising and lowering device 10 are made through a suitable electrical connector 64 mounted on the inclined portion of frame 16. A screw cap 66 mounted on a chain 68 attached to frame 16 is used to cover electrical connector 64 when not in use.

Characteristic Features Of The 1/20 Scale System

Figures 4, 5, 6:
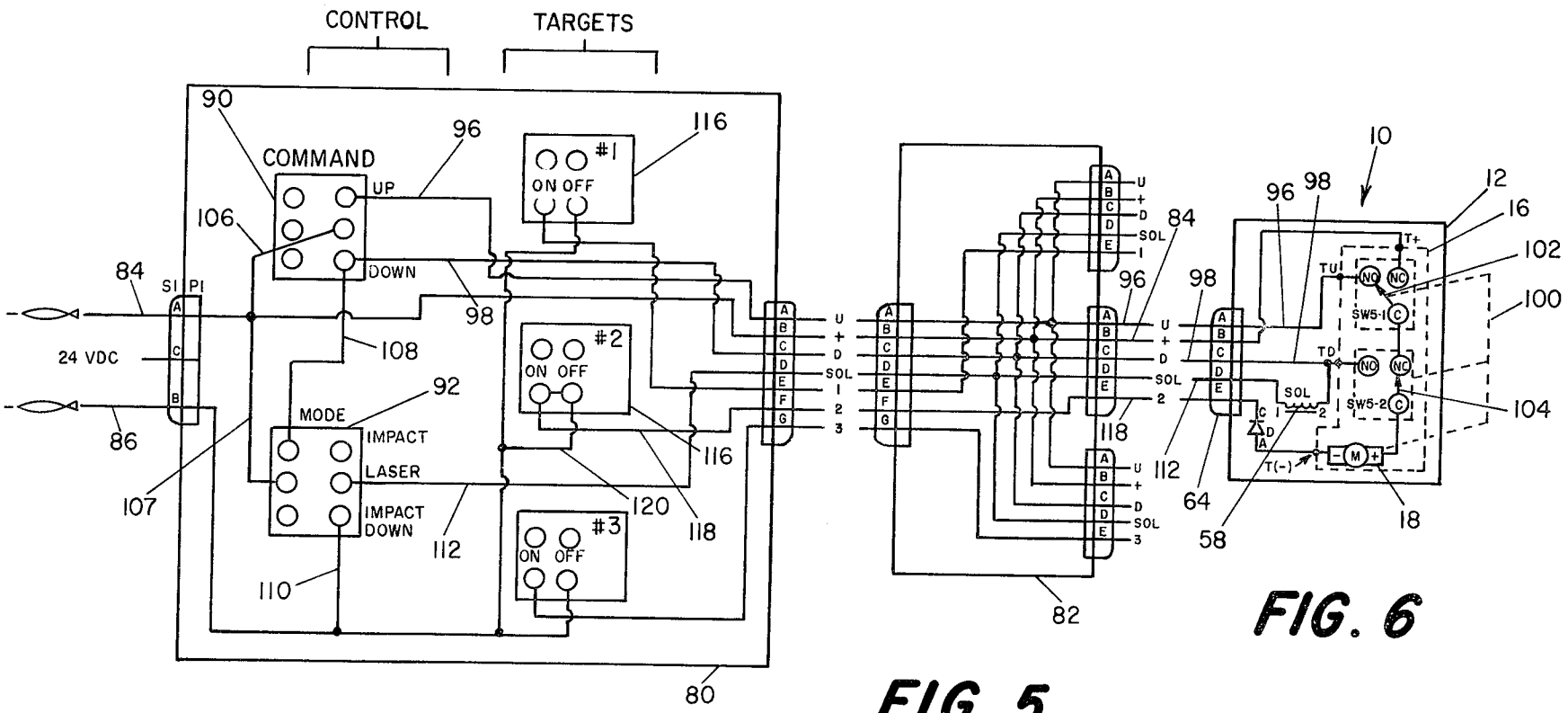
FIGS. 4, 5 and 6 (1/20 scale system) and 8, 9, and 10 11 (1/60–1/35 scale system) is a schematic circuit diagram of electrical circuitry for a control box, junction box and one raising and lowering device in accordance with the present invention.
Figure 7:
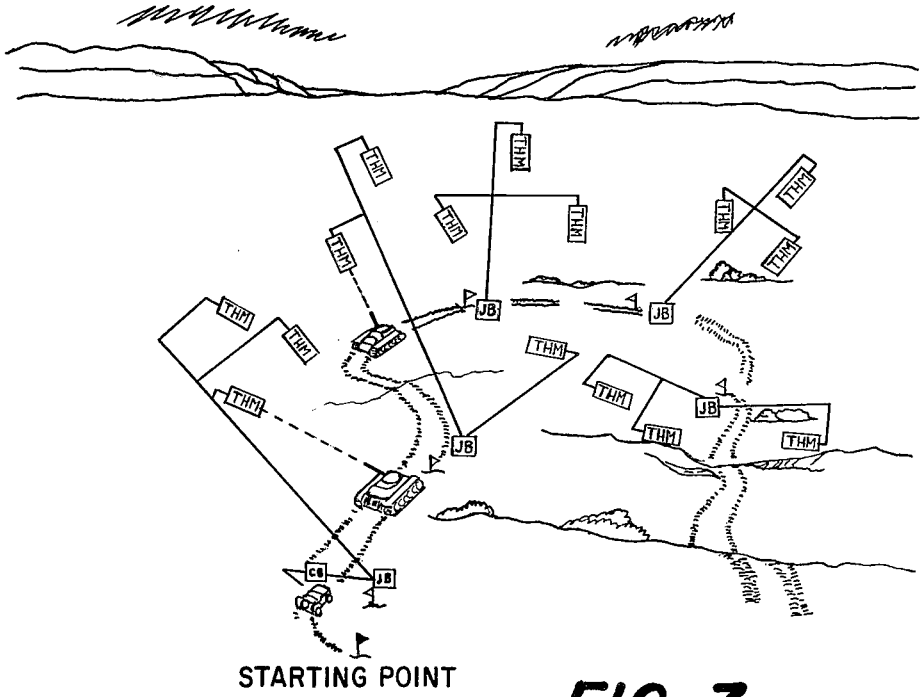
FIGS. 7 and 11 are diagrammatical representations of gunnery practice ranges employing the device systems of the present invention.

A schematic electric circuit diagram is shown in FIGS. 4, 5 and 6 for a simple system employing fifteen devices corresponding to device 10. In addition to the raising and lowering devices, (FIG. 6), the system comprises a control box 80 and a junction box 82. Leads 84 and 86 from control box 80 are connected respectively to the positive and negative terminals of a suitable 24 volt DC battery. In this system, control box 80 has two control switches (90 and 92) which are double-pole, double-throw switches, and three target switches 116 which are double-pole single-throw switches. Command switch 90 serves as one control switch while mode switch 92 serves as the other. Wires 96 and 98 run from command switch 90, through junction box 82, and ultimately to each separate device 10. The motor of device 10 has position control switches 102 and 104, under cover 24, which are engaged by drive gear 100 at raised and lowered positions which are powered by wire 84 and receive control power by wires 96 (to move to raised position) and 98 (to move to lowered position). Drive gear 100 acts to alternately contact either control switch 102 or control switch 104, respectively, to wires 96 or 98 and to power motor 18 to move to raised or lowered positions, respectively. Command switch 90 has a wire 106 connected to wire 84. Mode switch 92 also has a wire 107 connected to wire 84 and a wire 108 connected to wire 98. In addition, mode switch 92 has a wire 110 connected to wire 86 and a wire 112 which runs through junction box 82 to the solenoid in each device 10. Each target switch 116 is connected to a device 10. For example, the target switch 116 for target #2 is connected by a wire 118 to frame 16 and motor 18 of device 10 denoted #2. The other wire 102 from #2 target switch 116 is connected ultimately to ground wire 86.

In operation, the target raising and lower device 10 functions in the following manner. Each device 10 is positioned on the firing range at an appropriate location behind a mound of dirt to hide the device and to protect the device from live fire. Of course, each device 10 must be placed so that the target is visible when it is in the raised position and cannot be seen when it is in the lowered position. Each device 10 is connected by cables to junction box 82 and from there to remote control box 80. Control box 80 is connected to a suitable battery by wires 84 and 86.

When using laser simulated fire, corresponding target 44 is inserted into target holder 32 and mode switch 92 is moved to the middle, "LASER" position by the operator. In this position, no electrical contacts are made. For example, the raise the #2 laser target 44, the #2 target switch 116 is moved to the "ON" position which electrically connects wires 118 and 120. Command switch 90 is then moved from the middle position to the "UP" position. This connects wire 106 and 96 which completes the circuit through control switch 102, motor 18, wires 118 and 120 and finally ground wire 86. This connection causes motor 18 to rotate control shaft 20 approximately 85°. As control shaft 20 rotates, drive gear 100 disengages control switch 102 returning contact c to wire 84 the long leg 38 of control arm 34 engages flange 42 of target holder 32 and thus raises laser target 44 from a lowered position to a raised position. As laser target 44 reaches vertical, control switch 104 is engaged by drive gear 100 and moves out of connection with wire 96 so as to stop motor 18 in raised position. Firing commences immediately and the operator can leave laser target 44 associated with the #2 raising and lowering device in the raised position for whatever length of time desired, for instance 10 seconds, or until he sees that the target has been hit. To lower the target, command switch 90 is moved to the "DOWN" position. This completes an electrical connection between wires 106 and 98 which completes the circuit through control switch 104 and motor 18. Motor 18 then causes control shaft 20 to rotate in the opposite direction, drive gear 100 to disengage control switch 104 returning contact c to wire 84 and the short leg 40 of control arm 34 engages extension 46 of laser target 44 causing laser target 44 and target holder 34 to move to a lowered position where laser target 44 rests on raised handle 14. As laser target 44 reaches handle 14, control switch 102 is engaged by drive gear 100 causing control switch 102 to move out of connection with wire 98 thereby stopping motor 18. This leaves device 10 again ready to raise laser target 44 when command switch 90 is moved to the "UP" position. The devices denoted #1 and #3 are similarly operated.

When using live fire, impact target 48 is inserted into target holder 32 and mode switch 92 is moved to the upper "IMPACT" position by the operator. In this position, electrical contact is made between wires 106 and 108. To raise the #2 impact target 48, the #2 target switch is moved to the "ON" position as in the "LASER" mode. Then, command switch 90 is moved from the middle position to the "UP" position, and impact target 48 is raised. The operation of device 10 as impact target 48 is raised is similar to the operation of the device as laser target 44 is raised, except that when control switch 104 moves into contact with wire 98, the "DOWN" circuit is completed by wires 107, 108, 98, 118 and 120. The control arm 34 then returns to its lowered position as soon as the drive gear 100 engages control switches 102 and 104. It should be noted that control arm 34 does not bring impact target 48 down with its because short leg 40 of control arm 34 does not engage either flange 42 of target holder 32 nor extension 50 of impact target 48. Thus, impact target 48 is left in the raised position where it is held by the force which magnet 52 exerts on target holder 32.

As mentioned above, magnet holder 54 is adjusted so that live fire striking impact target 48 will knock target holder 32 away from magnet 52 and under these circumstances impact target 48 then continues to fall to its lowered position. If the operator desires to bring impact target 48 to its lowered position even though no live fire has struck impact target 48, mode switch 92 is moved to the "IMPACT DOWN" position connecting wires 112 and 110. Next command switch 90 is moved to the "DOWN" position. This completes the circuit through solenoid 58 via wires 106, 98, 112 and 110. Motor 18 is not affected because control switch 104 has already been returned to an open position when control arm 34 moved back to its lowered position just after impact target 48 was initially raised. Upon actuation, solenoid 58 causes armature 60 to move thereby causing knockdown arm 62 to pivot and jerk target holder 32 away from magnet 52. Once separated from the force of magnet 52, target holder 32 and impact target 48 continue to move to the lowered, rest position. Solenoid armature 60 returns to its rest position as soon as either command switch 90 or mode switch 92 is moved. Device 10 is then ready to raise impact target 48 again in response to movement of command switch 90 to the "UP" position and movement of mode switch 92 to the "IMPACT" position. The devices #1 and #3 are similarly operated.

Characteristic-Features of the 1/60–1/35 Scale System

Figure 11:
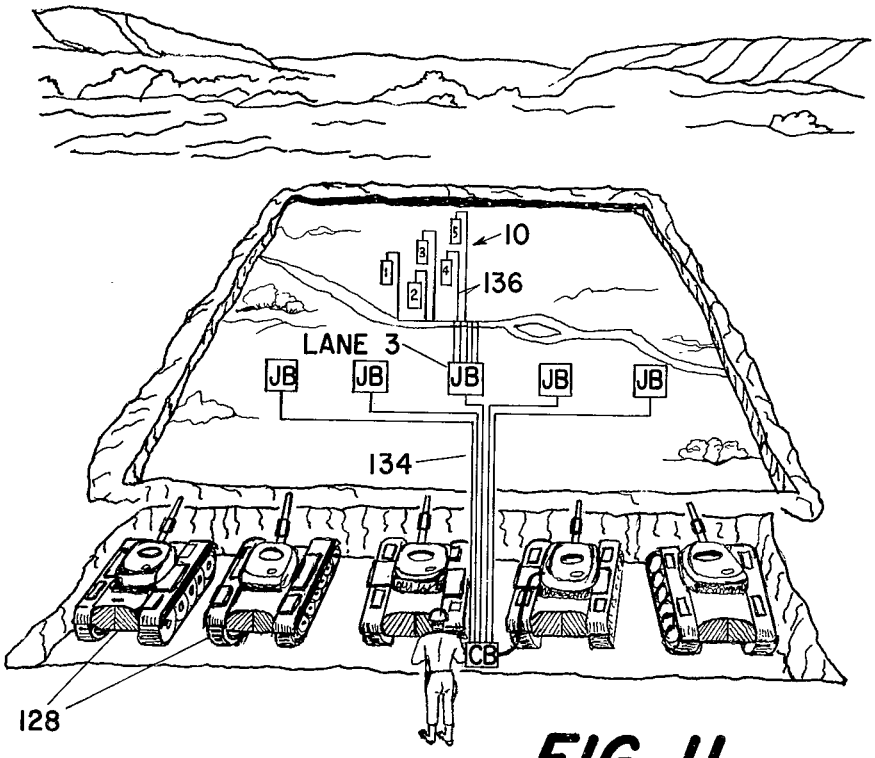
Figures 8, 9, 10:
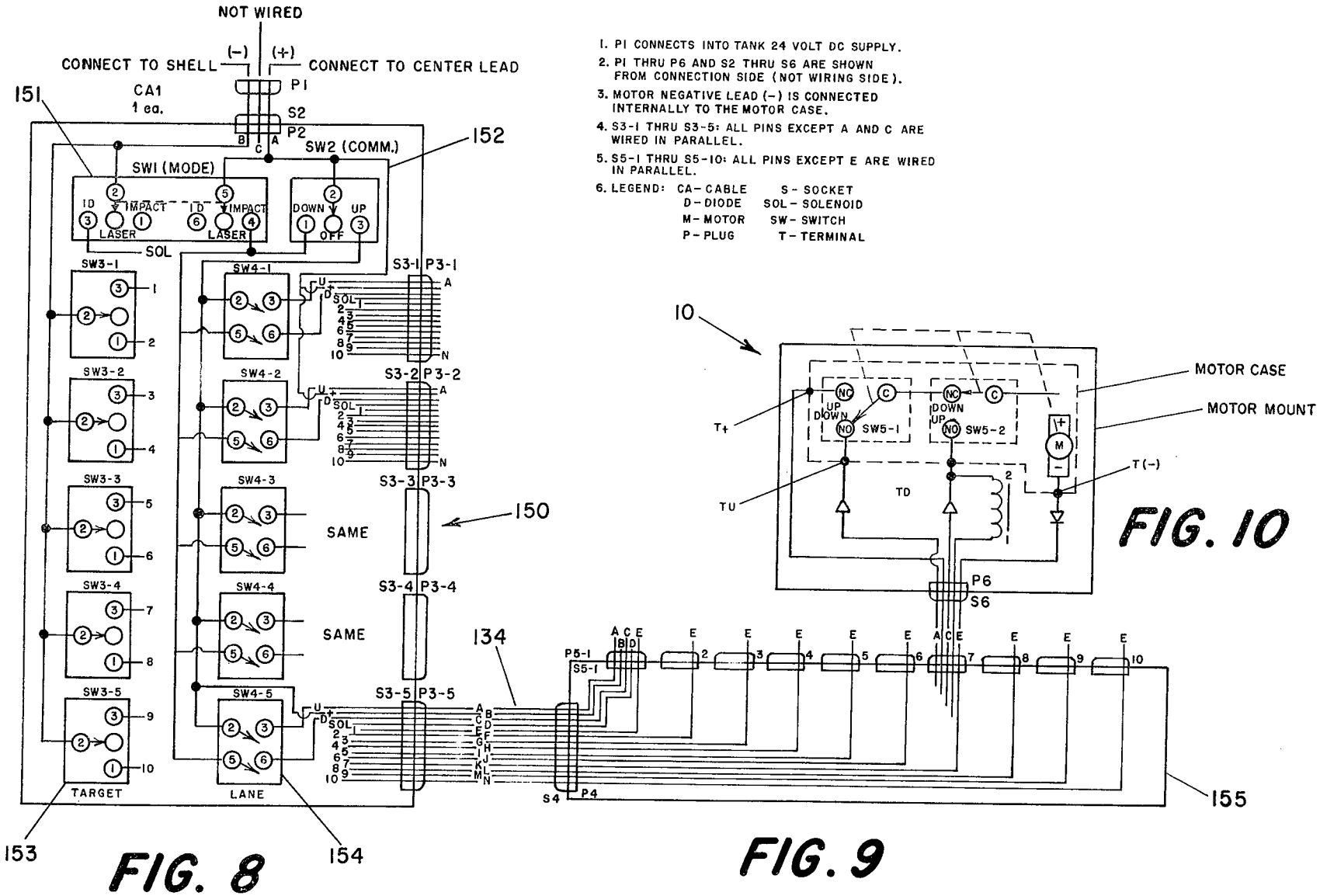

Referring to FIG. 11, a gunnery practice range is shown which is disposed for use by tanks 128. In this sytem, control box 150 has a similar mode switch 151 and a command switch 152. However, five single-pole double-throw target switches 153 are provided which control ten targets 10. Five single-pole throw lane switches 154 are also provided. With this arrangement, ten targets in each of five lanes can then be controlled by the target switches 153 and lane switches 154. As illustrated, five cables 134 run from control box 150 to five junction boxes 155. Ten cables (five which, denoted 136, are shown) run from each junction box 155 to ten raising and lowering devices 10. Five such devices 10 are shown for lane #3. Thus, by selecting a specific lane and target number, each of fifty targets can then be separately raised and lowered at the discretion of the operator. It will be appreciated that almost any number of targets and lanes can be controlled.

Although the invention has been described in detail with respect to exemplary embodiments thereof, it will be understood by those of ordinary skill in the art that variations and modifications may be effected within the scope and spirit of the invention.

I claim:

1. A portable training system having devices for raising and lowering replaceable targets which are used in gunnery practice, wherein each of the said devices is comprised of:

a. a target holder adapted to hold a said replaceable target;

b. a rotatable control arm for engaging said target holder;

c. a first remotely controller motor means for rotating said control arm from a rest position to cause corresponding rotational movement of said target holder between a first lowered position and a second raised position, and for returning said control arm to the rest position thereof immediately after said target holder has been moved to said raised position; and d. a second remotely controlled motor means for moving said target holder from the second raised position to the first lowered position.

2. A portable training system having devices as claimed in claim 1, wherein said second remotely controlled motor means includes a knockdown arm which engages said target holder in the second raised position; and a solenoid having an armature attached to said knockdown arm, such that upon activation of said solenoid, said armature causes said knockdown arm to move said target holder from the second, raised position to the first, lowered position.

3. A portable training system having devices as claimed in claim 2 wherein said target holder is made from a magnetic material and said device further comprises a magnet which engages and holds said target holder in the second raised position.

4. A portable training system having devices as claimed in claim 3, wherein said magnet is adjustably positionable so as to vary the force with which said target holder is held.

5. A portable training system having devices for raising and lowering a replaceable target used in gunnery practice, said device comprising:

a. a rotatable control shaft;

b. a target holder freely mounted on said control shaft and adapted to hold the replaceable target;

c. a control arm rigidly mounted on said control shaft for engaging said target holder;

d. a first remotely controlled motor means for rotating said control shaft in a first direction to cause rotational movement of said control arm, and corresponding rotational movement of said target holder, between a first lowered position and a second raised position and for rotating said control shaft in a second direction to cause rotational movement of said control arm from the second raised position to the first lowered position;

e. a second remotely controlled motor means for moving said target holder from the second raised position to the first lowered position; and f. remote control means for controlling said first and second motor means such that in first mode of operation using a replaceable target of a first type said control arm engages said target holder as both said control arm and said target holder move from the first lowered position to the second raised position, and said control arm engages the replaceable target and hence said target holder as said control arm and said target holder move from the second raised position to the first lowered position; and such that in second mode of operation using a replaceable target of a second type, said contol arm engages said target holder as both said control arm and said target holder move in said first direction from the first lowered position to the second raised position and said control arm disengages from said target holder when said control arm moves in said second direction leaving said target holder in the second raised position said target holder being moved from the second raised position to the first lowered position by said second remotely controlled motor means.

6. A portable training system having devices as claimed in claim 5, wherein said second remotely controlled motor means includes a knockdown arm which engages said target holder in the second raised position and a solenoid having an armature attached to said knockdown arm such that upon activation of said solenoid, said armature causes said knockdown arm to move said target holder from the second raised position to the first lowered position.

7. A portable training system having device as claimed in claim 6 wherein said target holder is made from a magnetic material, and said device further comprises a magnet which engages and holds said target holder in the second raised position.

8. A portable training system having devices as claimed in claim 7 wherein said magnet is adjustably positionable so as to vary the force which said target holder is held.

* * * * *